US008176860B2

(12) United States Patent
Shimizu et al.

(10) Patent No.: US 8,176,860 B2
(45) Date of Patent: May 15, 2012

(54) SEWING MACHINE

(75) Inventors: Akie Shimizu, Nagoya (JP); Hirokazu Hirose, Chiryu (JP); Yuki Ihira, Kakamigahara (JP); Yoshio Nishimura, Nagoya (JP); Yoshinori Nakamura, Toyohashi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 410 days.

(21) Appl. No.: 12/461,118

(22) Filed: Jul. 31, 2009

(65) Prior Publication Data

US 2010/0031860 A1 Feb. 11, 2010

(30) Foreign Application Priority Data

Aug. 5, 2008 (JP) ..... 2008-201861

(51) Int. Cl.
*D05B 69/00* (2006.01)

(52) U.S. Cl. ..... 112/221

(58) Field of Classification Search ..... 112/220, 112/273, 221, 278, 470.01, 470.03, 470.04, 112/117, 272, 315, 281; 700/130, 131, 132, 700/136, 137

See application file for complete search history.

(56) References Cited

U.S. PATENT DOCUMENTS

| | | | | |
|---|---|---|---|---|
| 4,343,249 | A * | 8/1982 | Takenoya et al. | 112/456 |
| 6,450,110 | B1 * | 9/2002 | Bruhl et al. | 112/470.01 |
| 7,325,502 | B2 * | 2/2008 | Konig et al. | 112/475.02 |
| 2008/0078313 | A1 | 4/2008 | Hamajima | |

FOREIGN PATENT DOCUMENTS

| | | |
|---|---|---|
| JP | A-2002-292175 | 10/2002 |
| JP | A-2008-79998 | 4/2008 |

* cited by examiner

*Primary Examiner* — Tejash Patel
(74) *Attorney, Agent, or Firm* — Oliff & Berridge, PLC

(57) ABSTRACT

A sewing machine including a needle bar; a sewing needle attached to the lower end of the needle bar; a needle bar drive mechanism vertically driving the needle bar; a presser foot capable of applying releasable pressure on a workpiece cloth and that releases the pressure to allow manual movement and sewing of the workpiece cloth; a regulatory needle including a tip and being capable of assuming a pierced state where the tip is pierced through the workpiece cloth and a non-pierced state, wherein the regulatory needle is moved along with the workpiece cloth while retaining the pierced state of the tip; a regulatory needle drive unit vertically driving the regulatory needle between the pierced state and the non-pierced state in coordination with vertical movement of the sewing needle; and a regulatory needle regulator limiting horizontal movement of the regulatory needle so as not to exceed a predetermined stitch pitch.

8 Claims, 11 Drawing Sheets

SEWING MACHINE

CROSS-REFERENCE TO RELATED APPLICATIONS

This application is based upon and claims the benefit of priority from the prior Japanese Patent Application 2008-201861, filed on Aug. 5, 2008, the entire contents of which are incorporated herein by reference.

FIELD

The present disclosure relates to a sewing machine and more particularly to so called free motion sewing machine that forms stitches while manually feeding a workpiece cloth.

BACKGROUND

Sewing machines have been known which are capable of executing a so called free motion sewing operation. In a free motion sewing operation, a feed dog for longitudinally feeding a workpiece cloth is inactivated within a bed and a presser foot for applying pressure on the workpiece cloth releases its pressure exerted on the workpiece cloth. The user is allowed to manually feed the workpiece cloth freely under such state. The free motion sewing operation will end up in poor looking stitches if the stitches are not formed at a constant stitch pitch. However, forming stitches at a constant stitch pitch through manual feeding of the workpiece cloth has been a difficult task for inexperienced users.

To address such difficulties, a sewing machine capable of executing the free motion sewing operation at a constant stitch pitch is proposed, for example, in JP-2002-292175 A hereinafter referred to as patent publication 1. The disclosed sewing machine is provided with a distance measuring element which measures the distance of travel of fed workpiece cloth and a needle speed changing element that changes operating speed of the sewing needle based on the measurement. In another example of a sewing machine disclosed in JP 2008-79998 A hereinafter referred to as patent publication 2, an imaging element and a feed amount regulator are provided. Under the disclosed configuration, the feed amount of workpiece cloth is calculated based on the image data captured by the imaging element. The feed amount regulator compares the calculated feed amount with a predetermined stitch pitch and limits the feed amount based on the comparison.

However, the sewing machine disclosed in patent publication 1 requires additional features such as the distance measuring element and the needle speed changing element, whereas the sewing machine disclosed in patent publication 2 requires additional features such as the imaging element and the feed amount regulator. Both sewing machines disadvantageously require complicated configurations.

SUMMARY

One object of the present disclosure is to provide a sewing machine that allows even inexperienced users to form stitches at a constant stitch pitch in free motion sewing in a simple configuration.

In one aspect of the present disclosure there is provided a sewing machine including a needle bar; a sewing needle attached to the lower end of the needle bar; a needle bar drive mechanism that vertically drives the needle bar; a presser foot that is capable of applying releasable pressure on a workpiece cloth and that releases the pressure to allow manual movement and sewing of the workpiece cloth; a regulatory needle that includes a tip and that is capable of assuming a pierced state in which the tip is pierced through the workpiece cloth and a non-pierced state, wherein the regulatory needle is moved along with the workpiece cloth while retaining the pierced state of the tip; a regulatory needle drive unit that vertically drives the regulatory needle between the pierced state and the non-pierced state in coordination with vertical movement of the sewing needle; and a regulatory needle regulator that limits horizontal movement of the regulatory needle in the pierced state so that the horizontal movement does not exceed a predetermined stitch pitch.

According to the above described configuration, the tip of the regulatory needle in the pierced state is allowed to move along with the workpiece cloth and the regulatory needle is driven vertically by the regulatory needle drive unit in coordination with the vertical movement of the sewing needle. The regulatory needle regulator limits the horizontal movement of the regulatory needle in the pierced state so that the amount horizontal movement does not exceed a predetermined stitch pitch. Thus, when the user manually transfers the workpiece cloth in free motion, the movement of the workpiece cloth with the regulatory needle in the pierced state does not and is not allowed to exceed the predetermined stitch pitch. The above configuration allows formation of stitches at a constant stitch pitch and even inexperienced users can readily perform free motion sewing at a constant stitch pitch.

BRIEF DESCRIPTION OF THE DRAWINGS

Other objects, features and advantages of the present disclosure will become clear upon reviewing the following description of the illustrative aspects with reference to the accompanying drawings, in which.

DETAILED DESCRIPTION

Figure 1:
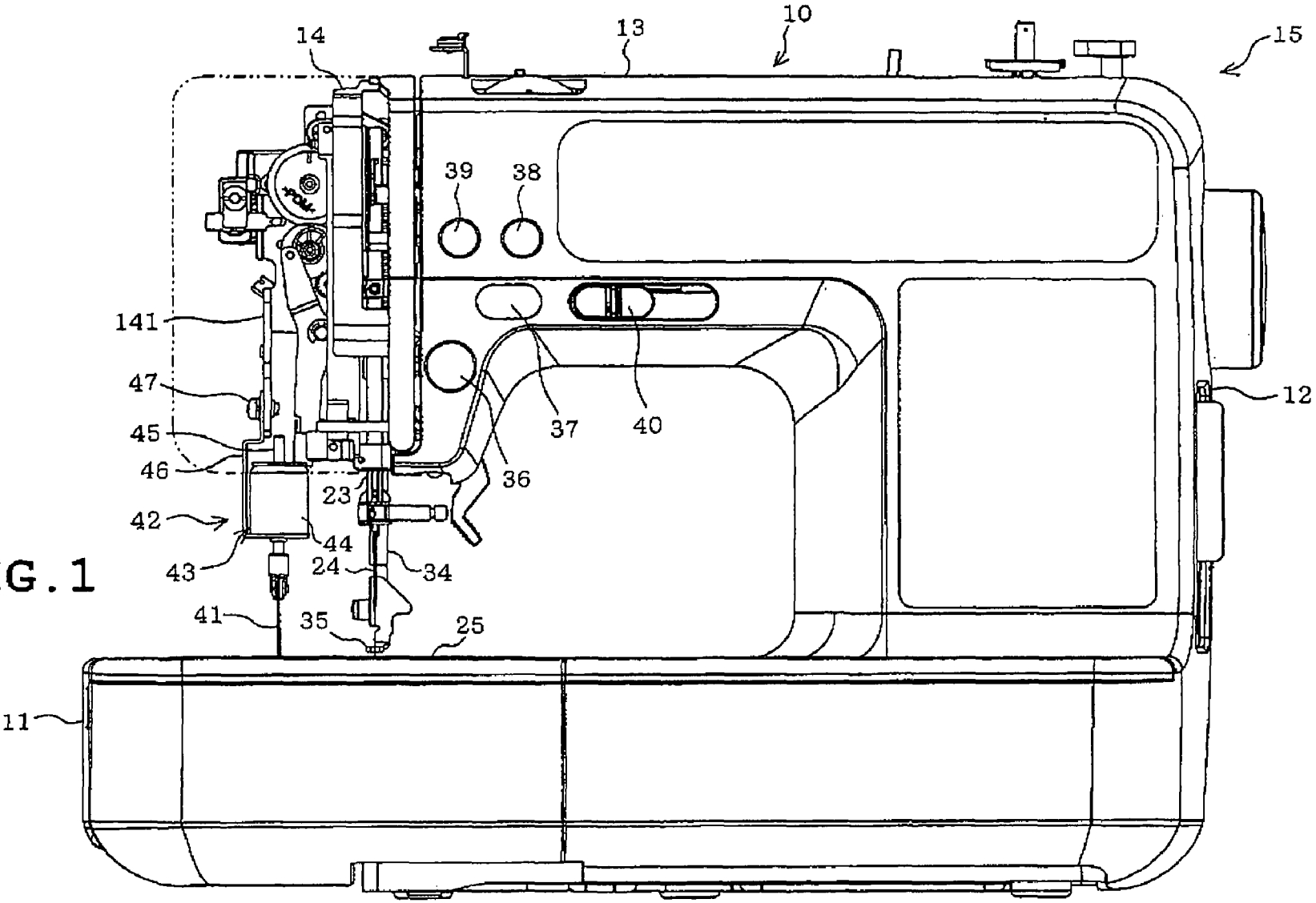
FIG. 1 is a front view of a sewing machine according to one exemplary embodiment of the present disclosure with a cover of a sewing machine head removed.

A description will be given hereinafter on exemplary embodiments of the present disclosure. Elements that are substantially identical between the exemplary embodiments are identified with identical reference symbols and their descriptions will not be given if once described.

FIGS. 1 to 10 depict a sewing machine according to a first exemplary embodiment. A sewing machine 10 includes a bed 11, a pillar 12 standing on the right end of bed 11, an arm 13 extending leftward over bed 11 from the upper end of pillar 12, and a head 14 defined at the left end of arm 13. An exterior cover 15 is provided over bed 11, pillar 12, arm 13, and head 14.

Figure 2:
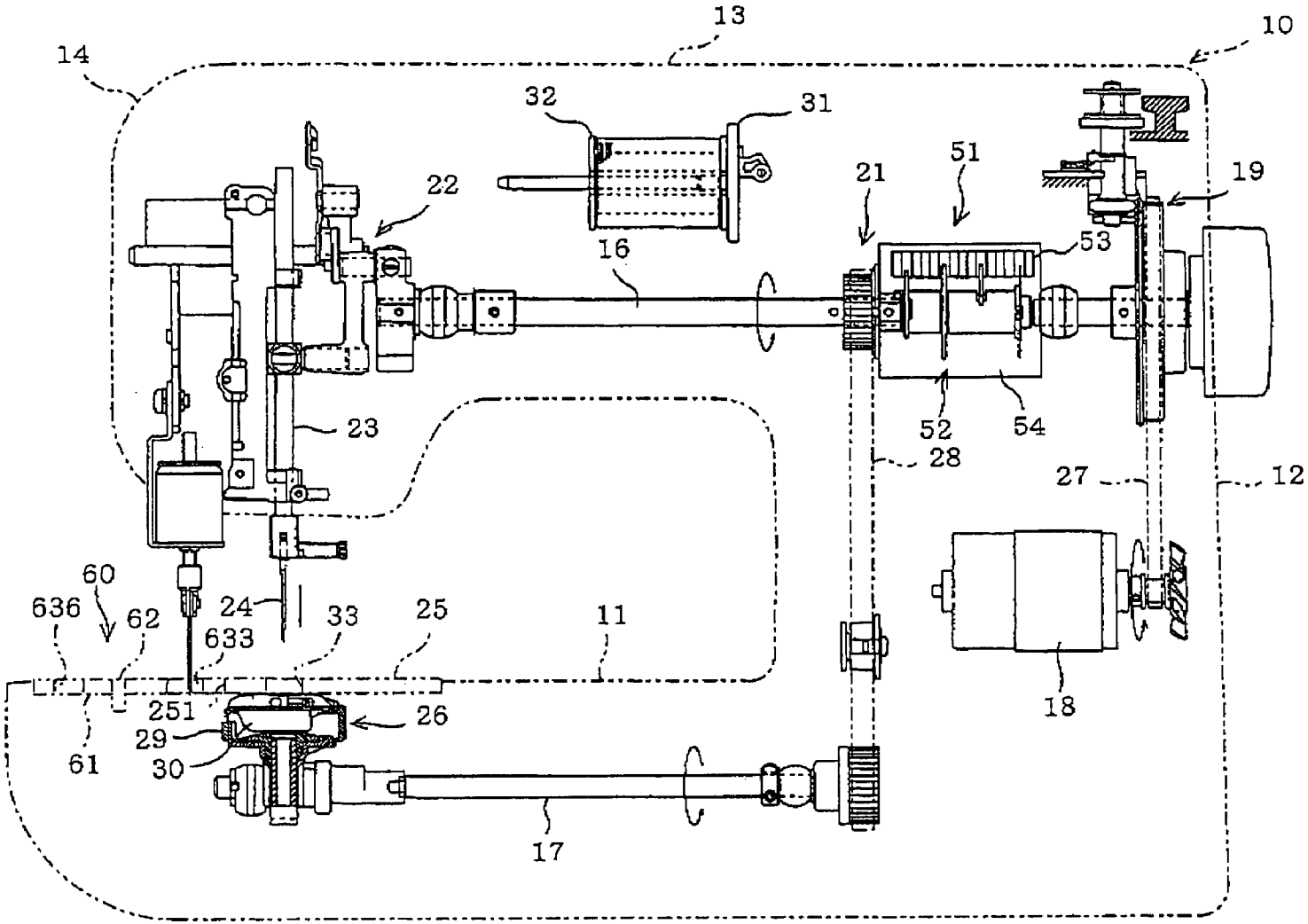
FIG. 2 schematically illustrates a mechanical configuration of the sewing machine.

Referring now to FIG. 2, sewing machine 10 is further provided with a main shaft 16, a lower shaft 17, a sewing machine motor 18, an upper transmission mechanism 19, a lower transmission mechanism 21, a needle bar drive mechanism 22, a needle bar 23, a sewing needle 24, a needle plate 25, and a shuttle 26. Main shaft 16 extends laterally within arm 13 and is supported rotatably by a bearing not shown. Lower shaft 17 extends laterally within bed 11 and is also supported rotatably by a bearing not shown. Sewing machine motor 18, upper transmission mechanism 19, and a lower transmission mechanism 21 are stored within pillar 12. The rotational drive force generated by sewing machine motor 18 is transmitted to main shaft 16 through a belt 27 provided at upper transmission mechanism 19, and the rotational drive force of main shaft 16 is in turn transmitted to lower shaft 17 through belt 28 provided at lower transmission mechanism 21. Rotational drive force of sewing machine motor 18 is thus, transmitted to main shaft 16 through upper rotational transmission mechanism 19, and from main shaft 16 to lower shaft 17 through lower rotational transmission mechanism 21. According to the above described configuration, the rotation of sewing machine motor 18 causes the rotation of main shaft 16 and lower shaft 17.

Figure 5:
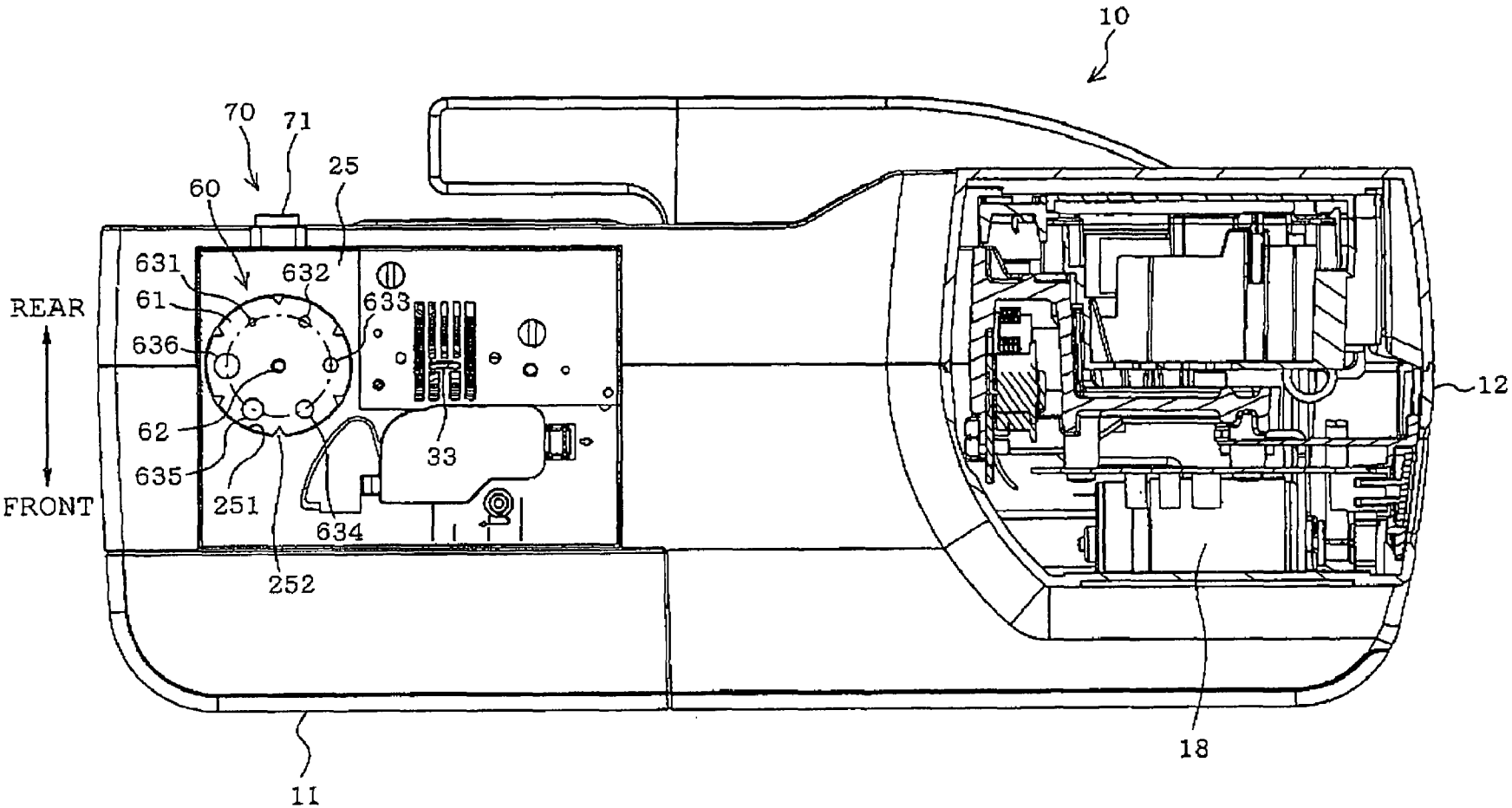
FIG. 5 is a plan view of a needle plate and a bed.

Needle bar drive mechanism 22 is provided on the left end of main shaft 16. Needle bar 23 is provided within head 14 of sewing machine 10 and its lower end protrudes downward from cover 15 covering head 14. Needle bar drive mechanism 22 transforms the rotary movement of main shaft 16 into a vertical movement of needle bar 23. Needle bar 23 is vertically reciprocated once as main shaft 16 is rotated once. Needle bar 23 has a sewing needle 24 detachably attached to its lower end. Bed 11 has needle plate 25 provided in opposition of head 14. Within bed 11 below needle plate 25, shuttle 26 comprising a horizontal shuttle composed of an outer shuttle 26 and an inner shuttle 30 is provided. Shuttle 26 receives detachable attachment of bobbin thread bobbin not shown within inner shuttle 30. Outer shuttle 29 is driven in rotation by lower shaft 17. On the upper portion of arm 13, a thread spool attachment 31 is provided to receive a detachable attachment of a thread spool 32 that provides supply of needle thread. Needle plate 25 has a needle hole 33 defined on it for allowing penetration of sewing needle 24 as can be seen in FIG. 5.

Referring back to FIG. 1, head 14 further contains a presser bar 34. Presser bar 34 is oriented upright relative to needle plate 25 and is vertically movably supported by a sewing machine frame not shown. Presser bar 34 has a presser foot 35 not shown attached to its lower end. Presser foot 35 presses the subject of the sewing operation, which is typically a workpiece cloth not shown, against needle plate 25. Though not shown in detail, presser foot 35 releases its pressure on the workpiece cloth when sewing in free motion to allow the workpiece cloth to be moved freely by manual transfer.

At the lower front face of head 14, a start/stop switch 36 is provided for starting or stopping a sewing operation. Depression of start/stop switch 36 causes sewing machine motor 18 to be activated or stopped. Other switches and controls such as a back stitch switch 37, a needle vertically moving switch 38, a thread cut switch 39, and a speed adjustment dial 40 are provided on the front faces of head 14 and arm 13. Back stitch switch 37, when operated, reverses the cloth feed direction; whereas needle vertically moving switch 38 alternately transfers sewing needle 24 at an upper needle stop position and a lower needle stop position; thread cut switch 39 activates a needle cut mechanism not shown that cuts the needle thread and bobbin thread at the end of a sewing operation; and speed adjustment dial 40 makes adjustments in sewing speed, in other words, the rotational speed of main shaft 16.

At the lower end of head 14, a regulatory needle 41 which penetrates in an out of the workpiece cloth and a regulatory needle driving element 42 which vertically drives regulatory needle 41 are provided so as to be situated at the left side proximity of sewing needle 24. Regulatory needle driving element 42 comprises a coil 44 and an electromagnetic actuator 43 provided with a regulatory bar 45. Regulatory bar 45 retains its upper position shown in FIG. 3 by a return spring not shown. Coil 44, when energized, produces electric magnetism that causes regulatory bar 45 to be driven downward against the bias of return spring. Regulatory needle 41 is provided interchangeably at the lower end of regulatory bar 45. Thus, when coil 44 is de-energized, regulatory needle 41 retains its upper position, whereas when coil 44 is energized, regulatory needle 41 is moved to a lower position shown in FIG. 4 to penetrate the workpiece cloth. Electromagnetic actuator 43 is supported by a support member 46 which is detachably attached by a fastening screw 47 to a frame 141 secured on the sewing machine frame. Thus, regulatory needle 41 and regulatory needle driving element 42 may be removed from sewing machine 10, when executing a normal sewing operation, for example.

Figure 3:
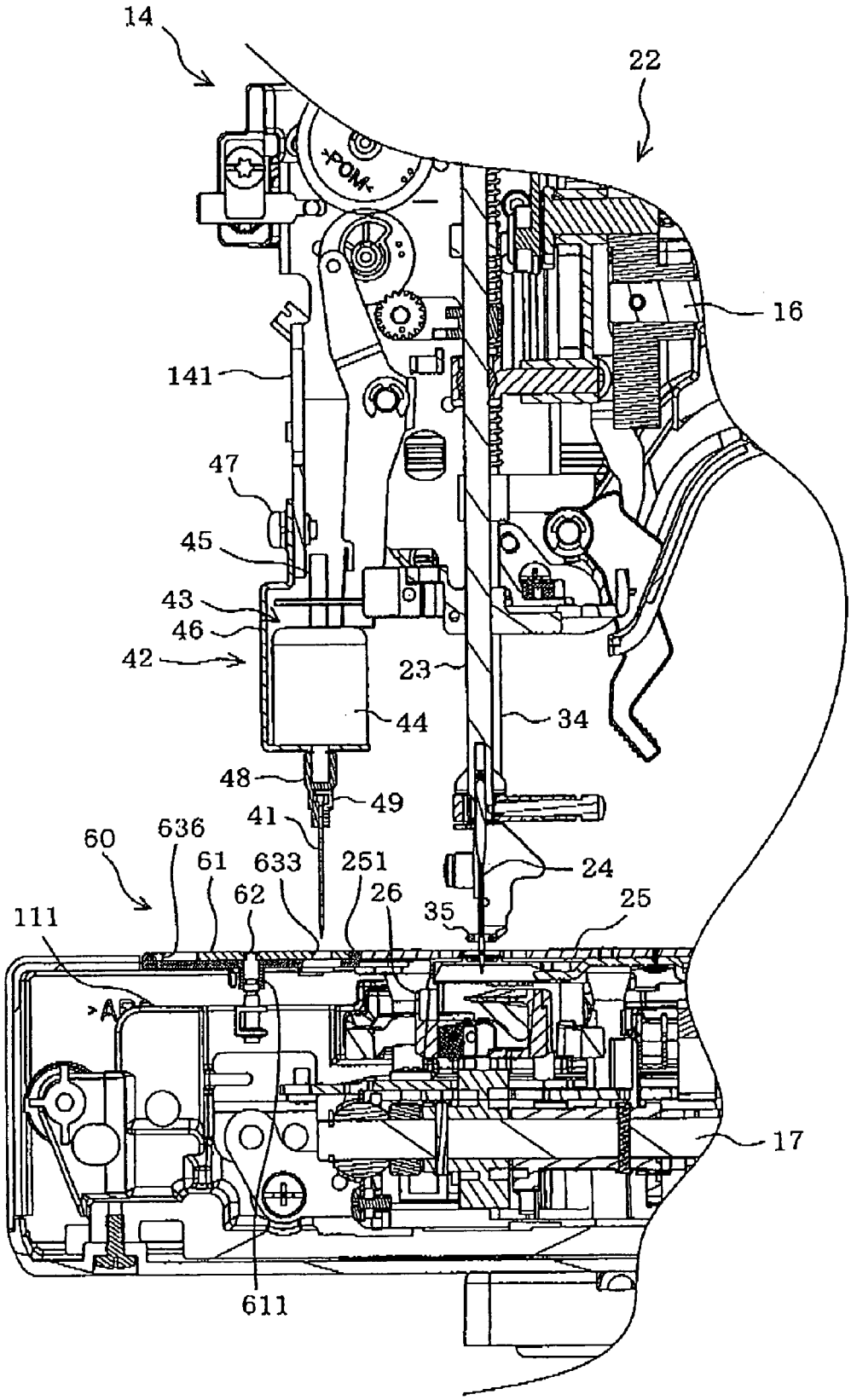
FIG. 3 is a partial cross sectional front view of a regulatory needle in an upper position.
Figure 4:
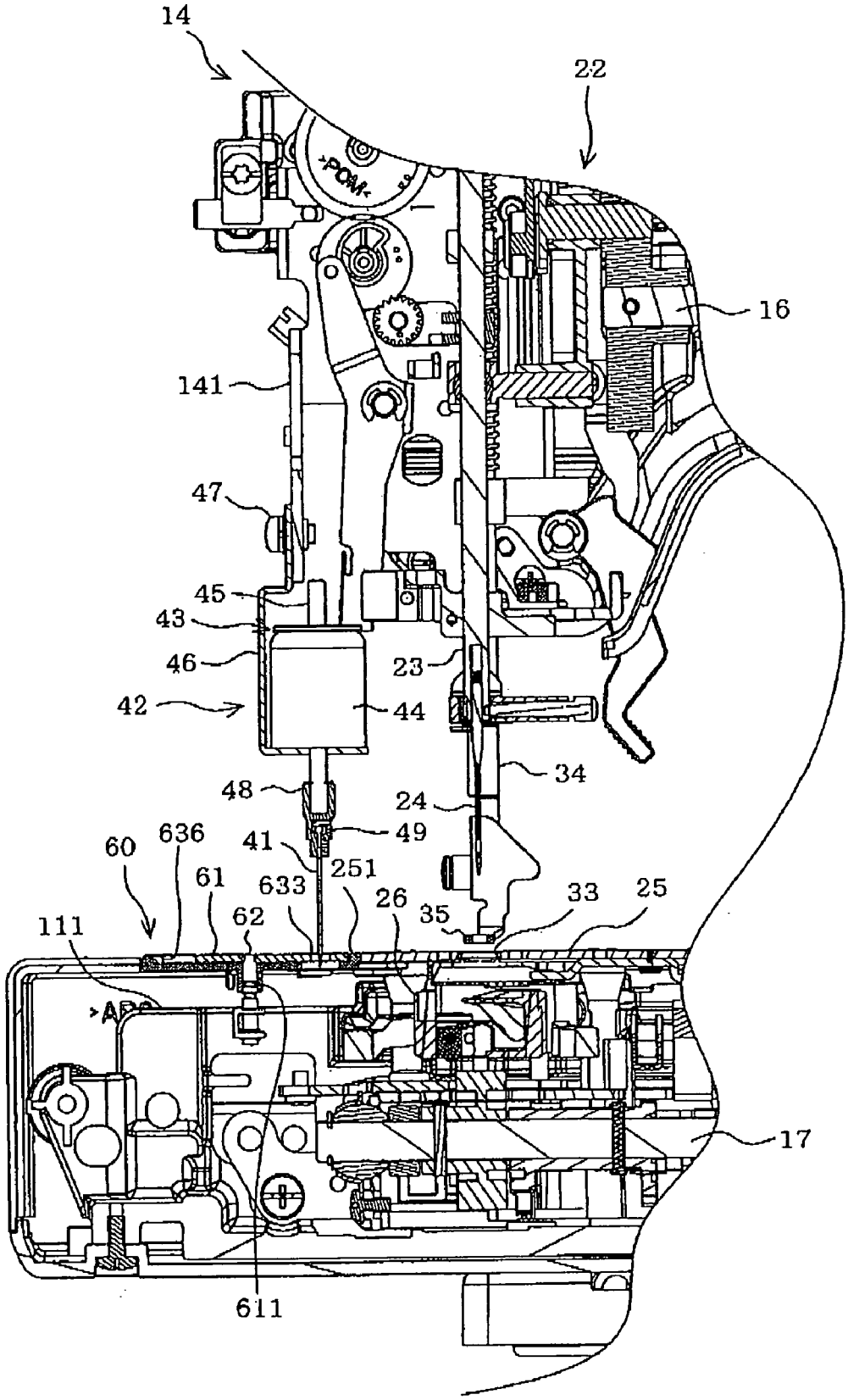
FIG. 4 is a partial cross sectional front view of a regulatory needle in a lower position.

Regulatory needle 41 comprises an elastically deformable spring wire, for example. Regulatory needle 41 has a sharpened tip to allow penetration in and out of workpiece cloth. The base end of regulatory needle 41 is interchangeably secured to regulatory bar 45 of electromagnetic actuator 43. To elaborate, the base end of regulatory needle 41 is clamped between a holder 48 mounted at the lower end of regulatory bar 45 and clamp member 49 as can be seen in FIGS. 3 and 4. Clamp member 49 is screw fastened to holder 48 by a screw not shown and allows replacement of regulatory needle 41 by loosening the fastening screw.

Referring now to FIG. 2, arm 13 includes a sensor section 51. Sensor section 51 senses the vertical position of sewing needle 24 through sensing of rotational phase of main shaft 16. Sensor section 51 comprises a known sensor provided with a plurality of shutters 52, a photo interrupter 53 and a substrate 54. Shutters 52 are secured on main shaft 16 and photo interrupter 53 is provided on substrate 54 secured on the sewing machine frame so as to oppose shutters 52. Though not shown in detail, shutters 52 are each sectoral having a unique angle and provided at different phase positions. The rotational phase of main shaft 16 can be sensed by sensing the unshown edges of shutters 52 by photo interrupter 53. The vertical position of sewing needle 24 is recognized based on the sensed phase of main shaft 16. The control circuit not shown, controls the energization and de-energization of coil 44 of electromagnetic actuator 43 based on the incoming electric signals from photo interrupter 53.

Figure 7:
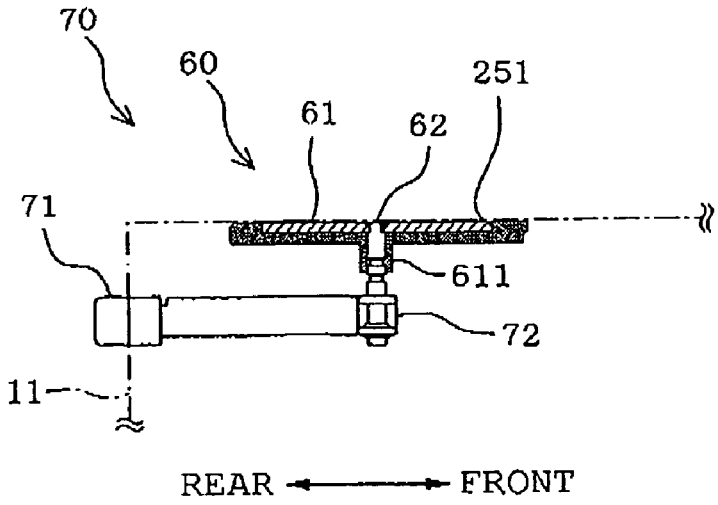
FIG. 7 is a cross sectional view taken along line VII-VII of FIG. 6.

Next, a description will be given on a regulatory needle regulator 60 with reference to FIGS. 3, 4, and 5. Regulatory needle regulator 60 is provided with a regulatory plate 61 which is fitted into a circular recess 251 defined on needle plate 25 so as to be at level, in other words, coplanar with the upper surface of needle plate 25. As can be seen in FIG. 5, regulatory plate 61 is disc shaped and is provided with a support shaft 62 at its center. As can be seen in FIGS. 3, 4 and 7, support shaft 62 extends downward from the underside of regulatory plate 61 to penetrate a bearing 611 provided at the lower central portion of circular recess 251, thereby allowing regulatory plate 61 to rotate about support shaft 62. Regulatory plate 61 is further provided with six holes 631, 632, 633, 634, 635, and 636 each having a unique inner diameter defined on the circumference centering on the center of support shaft 62 as can be seen in FIG. 5. The centers of holes 631 to 636 are disposed at 60 degree angular interval. When regulatory plate 61 assumes the position shown in FIG. 5, regulator needle 41 is inserted into hole 633 which is in the closest proximity of needle hole 33. When the workpiece cloth is manually transferred, the tension between sewing needle 24 and regulatory needle 41 tends to be reduced as the distance between needle hole 33 and hole 633 receiving regulatory needle 41, that is, the distance between sewing needle 24 and regulatory needle 41 is increased. Reduced tension at the workpiece cloth provides grounds for inconsistent stitch pitch and thus, hole 633 that assumes a position to allow penetration of regulatory needle 41 is moved as close as possible to needle hole 33 receiving sewing needle 24.

Figure 6:
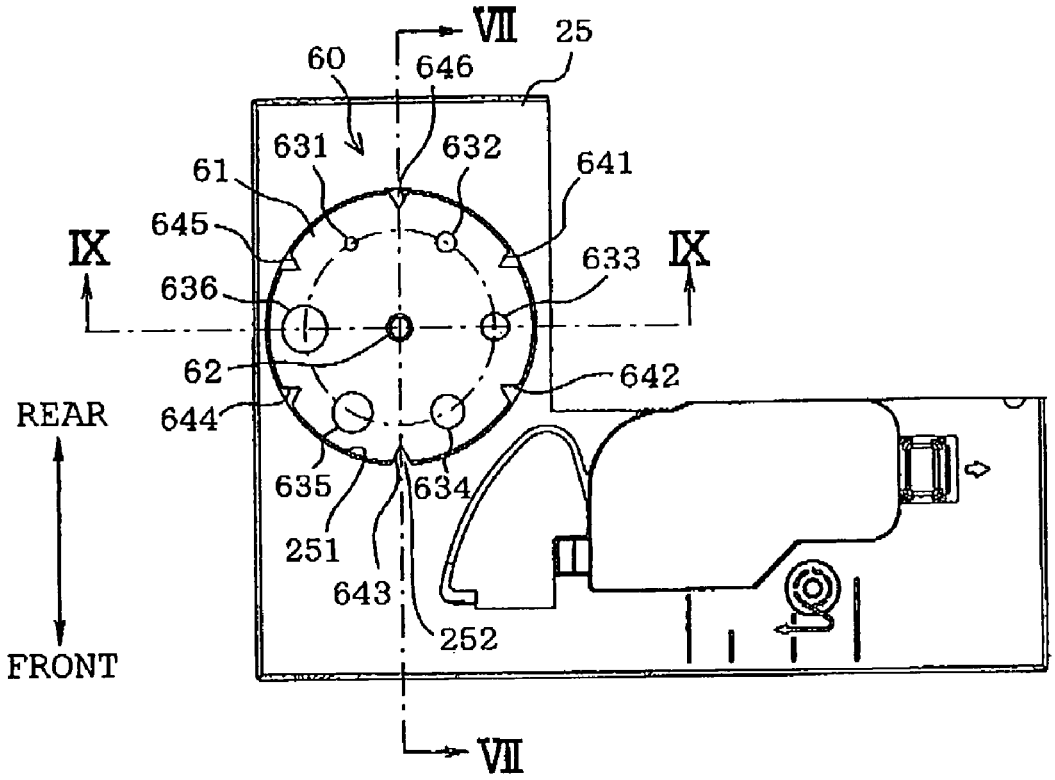
FIG. 6 is an enlarged view of the main features of the needle plate and a regulatory plate.

Referring now to FIG. 6, regulatory plate 61 is further provided with six V-shaped notches 641 to 646 on its outer peripheral portion. Notches 641 to 646 are arranged at 60 degree angular interval. On a portion of the inner wall of circular recess 251 defined on needle plate 25, a protrusion 252 is formed that protrudes radially inward in V-shape. The selective engagement of protrusion 252 with one of notches 641 to 646 determines the positioning of regulatory plate 61 relative to needle plate 25.

For instance, in FIG. 6, shows protrusion 252 being engaged with notch 643. At this instance, hole 633 is located below regulatory needle 41 such that the center of regulatory needle 41 is coincidental with the center of hole 633.

Figure 8:
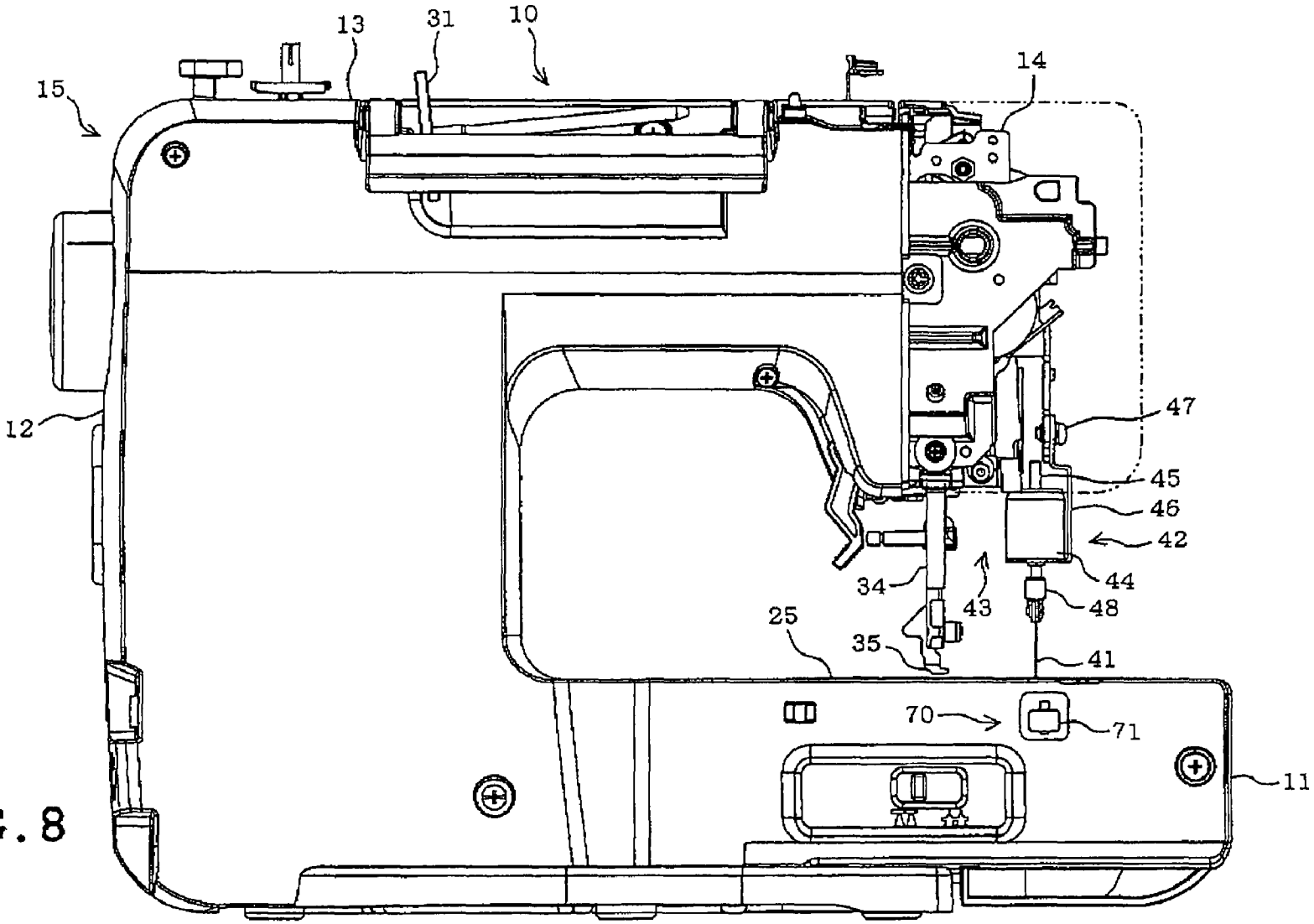
FIG. 8 is a rear view of the sewing machine with the cover of the sewing machine head removed.
Figure 9A:
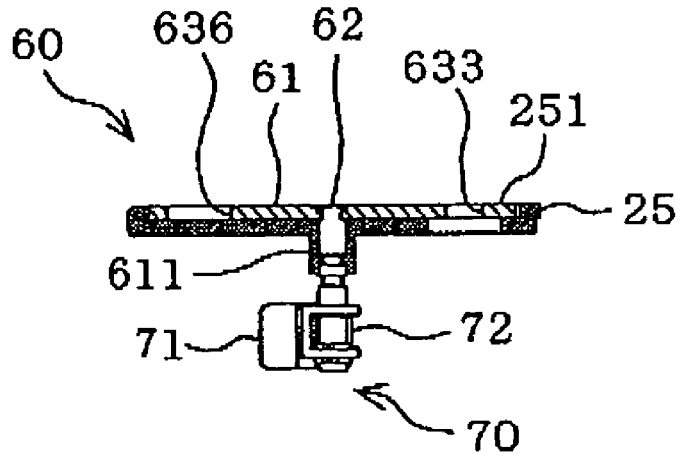
FIG. 9A is a cross sectional view taken along line IX-IX of FIG. 6 showing a lever in a lowered state.
Figure 9B:
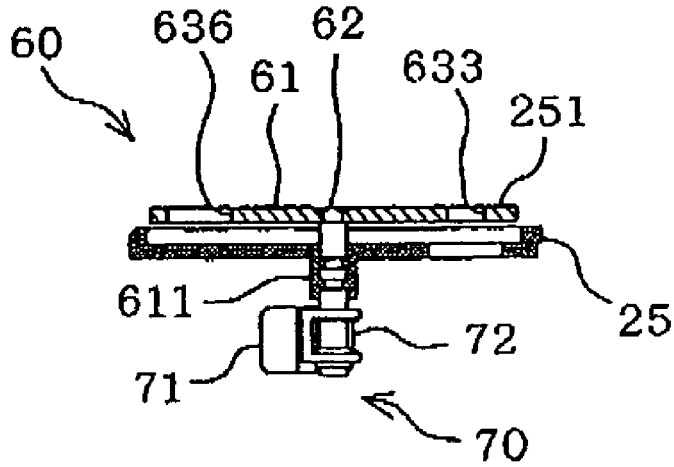
FIG. 9B is a cross sectional view taken along line IX-IX of FIG. 6 showing a lever in a lifted state.

Next, a description will be given on a hole selector 70 which selects the hole having the desired inner diameter among the six holes 631 to 636. Referring to FIG. 7, hole selector 70 comprises a lever 71 for vertically moving regulatory plate 61, and support shaft 62, and a support section 72. The rear end tip of lever 71 slightly protrudes rearward from the rear side surface of bed 11 as can be seen in FIGS. 5, 7, and 8 to allow the user to manually operate lever 71 in the vertical direction through this protruding tip. Support section 72 supports the lower end of support shaft 62 so as to be rotatable but axially unmovable. Thus, by lifting lever 71, the fitting engagement between regulatory plate 61 and circular recess 251 is cancelled to move regulatory plate 61 upward as shown in FIG. 9B. Thus, engagement of protrusion 252 with one of notches 641 to 646 (notch 643 in FIG. 6) is cancelled to allow rotation of regulatory plate 61 about support shaft 62. Then, regulatory plate 61 is rotated to locate one of the six holes 631 to 636 that has the desired inner diameter to be located in a position (in the right side relative to support shaft 62) as close as possible to needle hole 33 whereafter lever 71 is lowered to lower regulatory plate 61 back into fitting engagement with circular recess 251 as shown in FIG. 9A. Consequently, protrusion 252 is placed in engagement with one of notches 641 to 646 to determine the rotational positioning of regulatory plate 61. As described above, the hole through which regulatory needle 41 is inserted is selected from one of the six holes 631 to 636.

Regulatory plate 61 provided on needle plate 25 may be provided on bed 11, if found appropriate, depending on the size and shape of needle plate 25.

The timing in movement of regulatory needle 41 relative to sewing needle 24 will be described based on FIG. 10. Sewing needle 24 and regulatory needle 41 have been illustrated schematically for simplicity of description. Further, workpiece cloth not shown in the previous figures will be represented as workpiece cloth 100. Description will be given hereinafter with an assumption that regulatory plate 61 assumes a position in which hole 633 has been selected.

Figure 10A:
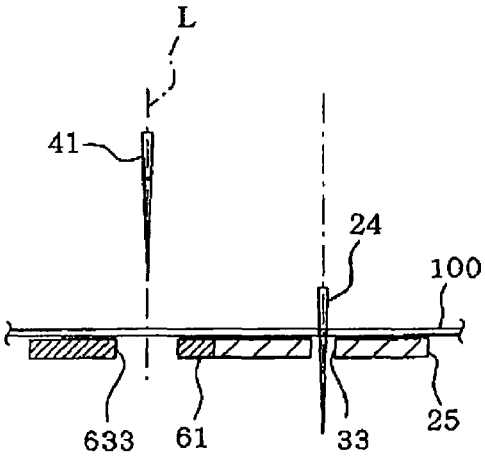
FIGS. 10A to 10D schematically illustrate timing in movement of regulatory needle relative to a sewing needle.

As can be seen in FIG. 10A, when sewing needle 24 is pierced through workpiece cloth 100, workipiece cloth 100 cannot be moved because it is anchored in place by sewing needle 24, and thus, regulatory needle 41 is displaced upward away from workpiece cloth 100. When regulatory needle 41 is in the upper position, regulatory needle 41 assumes the initial position residing on a center line L of hole 633.

Figure 10B:
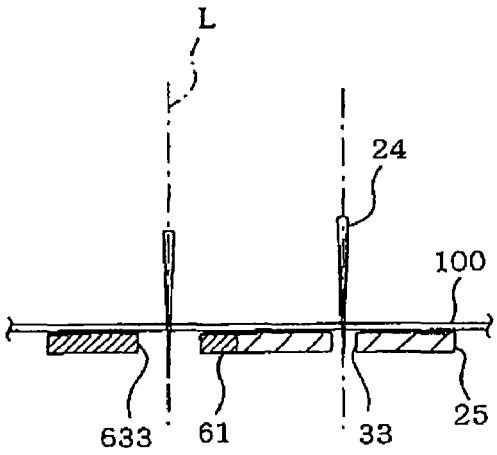

Then, as can be seen in FIG. 10B, as sewing needle 24 is elevated, regulatory needle drive unit 42 drives regulatory needle 41 downward so as to pierce workpiece cloth 100 before sewing needle 24 is lifted above workpiece cloth 100. Regulatory needle 41 is thus, pierced through workpiece cloth 100 by traveling downward below center line L of hole 633. Under such state, when sewing needle 24 is moved out of workpiece cloth 100, workpiece cloth 100 is allowed to be moved within the limitation given by regulatory needle 41. By piercing regulatory needle 41 through workpiece cloth 100 before sewing needle 24 is lifted above workpiece cloth 100, regulatory needle 41 can takeover the task of limiting the movement of workpiece cloth 100 from sewing needle 24.

Figure 10C:
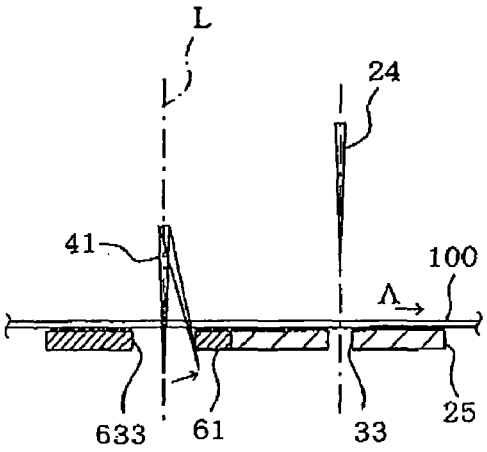

Then, as can be seen in FIG. 10C, by the time sewing needle 24 is lifted out of workpiece cloth 100, only regulatory needle 41 is pierced through workpiece cloth 100. Since regulatory needle 41 is made of elastically deformable material, workpiece cloth 100 can be manually moved freely. Even if work piece cloth 100 is moved in the horizontal direction indicated by arrow A in FIG. 10C, regulatory needle 41 is elastically deformed under the influence of the movement of workpiece cloth 100 to show a bend However, since the tip of regulatory needle 41 is inserted into hole 633, further movement of regulatory needle 41 can be restricted once the tip of regulatory needle 41 is placed in contact with the inner wall of hole 633. Thus, workpiece cloth 100 can be moved to the extent of the radius of hole 633, meaning that the radius of hole 633 defines the stitch pitch. Accordingly, by selecting either of holes 631, 632, 634, 635, and 636 to replace hole 633, the distance of movement, in other words, the stitch pitch can be changed.

Figure 10D:
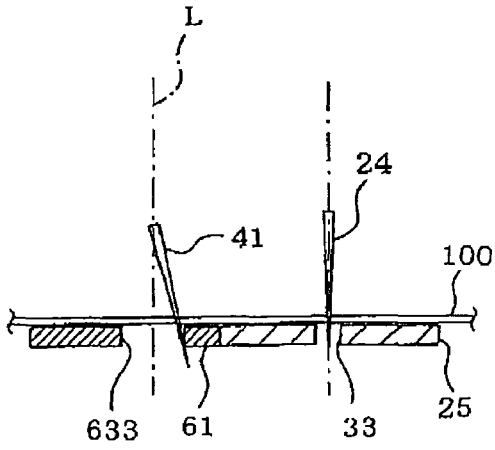

Then, as can be seen in FIG. 10D, regulatory needle drive unit 42 keeps regulatory needle 41 pierced through workpiece cloth 100 until sewing needle 24 is pierced through workipiece cloth 100. That is, regulatory needle drive unit 42 moves regulatory needle 41 upward after sewing needle 24 has pierced workpiece cloth 100. Since movement of workpiece cloth 100 is prohibited by the piercing of sewing needle 24, workpiece cloth 100 need not be limited in movement by regulatory needle 41. Regulatory needle 41 being lifted out of workpiece cloth 100 returns, from the bent state, to its original position on center line L of hole 633 by its own elasticity as shown in FIG. 10A.

As described above, regulatory needle 41 stays pierced through workpiece cloth 100 while workpiece cloth 100 is being moved manually. Thus, movement of workpiece cloth 100 can be limited reliably with preciseness.

Next, a description will be given on the operation and effect of the first exemplary embodiment.

Regulatory needle 41 is made of elastically deformable material and thus, can be moved along with workpiece cloth 100 with the tip of regulatory needle 41 pierced through workpiece cloth 100. The elastic deformation of regulatory needle 41 is limited by hole 633 of regulatory plate 61, in other words, workpiece cloth 100 is free to move within the radius of hole 633 meaning that the radius of hole 633 represent the stitch pitch According to the above described configuration, the user is allowed to readily execute free motion sewing with constant stitch pitch by merely moving workpiece cloth 100 such that the tip of regulatory needle 41 contacts the inner wall of hole 633 every time workpiece cloth 100 is manually fed.

The above configuration is further advantageous in that stitches with constant stitch pitch can be formed in a simple configuration comprising an elastically deformable regulatory needle 41 and regulatory plate 61 having a hole 633 allowing penetration of regulatory needle 41.

Regulatory plate 61 is disc shaped and is provided with six holes 631 to 636 having unique inner diameters. One of the six holes having the desired inner diameter is selected by rotating regulatory plate 61. Thus, constant stitch pitch can be obtained in a simple configuration by a simple operation.

Further, regulatory needle 41 is provided in the proximity of needle hole 33 allowing penetration of sewing needle 24 and thus, the distance between regulatory needle 41 and sewing needle 24 can be reduced. Such configuration minimizes the slack being produced between the regulatory needle 41 and sewing needle 24 when manually moving workpiece cloth 100 to allow the stitches to be formed precisely in constant stitch pitch.

In the first exemplary embodiment, regulatory needle drive unit 42 pierces regulatory needle 41 through workpiece cloth 100 before sewing needle 24 is lifted out of workpiece cloth 100 and stays pierced until sewing needle 24 is pierced through workpiece cloth 100. Thus, regulatory needle 41 stays pierced through workpiece cloth 100 while workpiece cloth 100 is being manually moved to reliably and precisely prevent movement of workpiece cloth 100 in excess of the predetermined stitch pitch.

Further, regulatory needle drive unit 42 is provided with electromagnetic actuator 43 that vertically moves regulatory needle 41. Thus, regulatory needle 41 can be vertically moved rapidly and precisely in a simple configuration.

Figure 11:
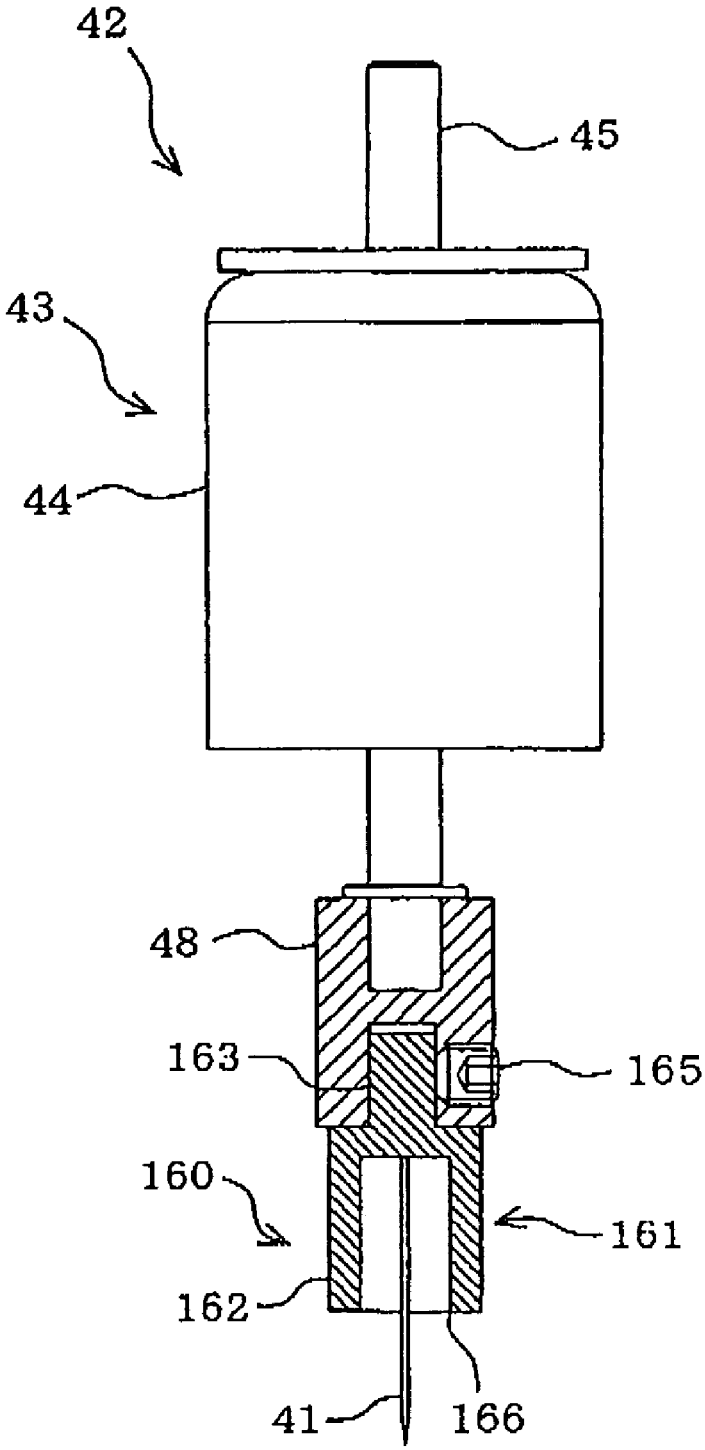
FIG. 11 is a front view of the main features of a second exemplary embodiment.

A description will now be given on a second exemplary embodiment of the present disclosure. FIG. 11 shows the portion constituting the main features of the sewing machine according to the second exemplary embodiment.

As can be seen in FIG. 11, the second exemplary embodiment differs from the first exemplary embodiment in the configuration of the regulatory needle regulator, which is identified in the second exemplary embodiment as regulatory needle regulator 160. Regulatory needle regulator 160 is provided with a needle guide 161 which is provided with a cylindrical section 162 that covers the entire outer periphery of the base end portion of regulatory needle 41. Regulatory needle 41 comprises an elastically deformable spring wire as was the case in the first exemplary embodiment. The center of cylindrical section 162 is located with the center of regulatory needle 41.

Figure 12:
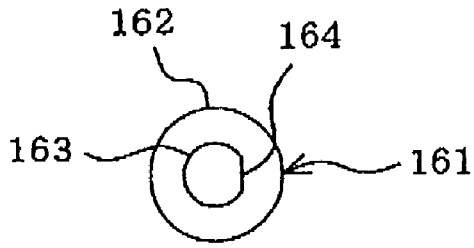
FIG. 12 is a plan view of a needle guide.

Needle guide 161 is provided integrally with a cylindrical head 163 at its upper end. A portion of the side surface of head 163 defines a planar section 164 shown in FIG. 12. Planar section 164 is placed in abutment with the tip of a later described fastening screw 165.

Electromagnetic actuator 43 has holder 48 secured on the lower end of regulatory bar 45 as described earlier. Holder 48 is provided with a fitting hole which establishes fitting engagement with head 163. Needle guide 161 having its head 163 being fitted into the fitting hole of the holder 48 is fastened unfastenably by fastening screw 165. Planar section 164 of head 163 is provided to avoid contact with fastening screw 165 which may become an impediment to the detachment of needle guide 161.

Regulatory needle regulator 160 being configured as described above is driven by electromagnetic actuator 43 to move up and down in coordination with the vertical movement of sewing needle 24 as in the first exemplary embodiment.

When workpiece cloth 100 is moved with the downwardly driven regulatory needle 41 pierced through it, regulatory needle 41 bends by elastic deformation as work piece cloth 100 is moved. As the lower end of regulatory needle 41 increases the degree of bend, regulatory needle 41 eventually contacts lower end 166 of the inner wall of cylindrical section 162. Stated differently, the movement of regulatory needle 41 is limited by the inner wall of cylindrical section 162. This means that the movement of workpiece cloth 100 is limited to half of the inner diameter of cylindrical section 162, that is, the radius of cylindrical section 162. When regulatory needle 41 is lifted out of workpiece cloth 100, it returns to the initial position which is located with the center of cylindrical section 162 by its own elasticity. As described above, half length of the inner diameter, in other words, the radius of cylindrical section 162 represents the stitch pitch.

Figure 13A:
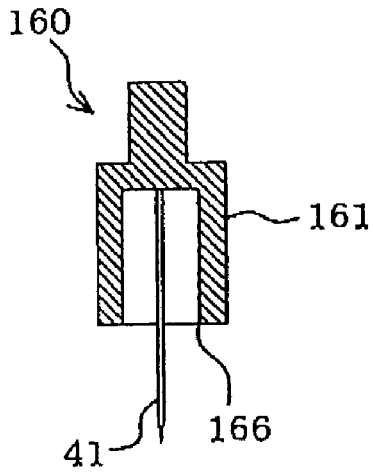
FIGS. 13A and 13B illustrate partial cross sectional views of cylindrical portions having different inner diameters.
Figure 13B:
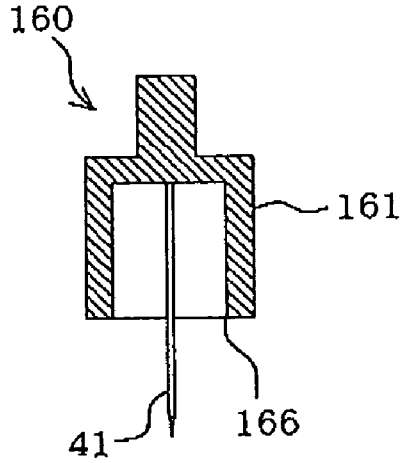

Further, as exemplified in FIGS. 13A and 13B, different types of needle guide 161 are provided that vary in the inner diameter of cylindrical portion 162. Thus, the user is allowed to sew in free motion in the desired stitch pitch by selectively attaching needle guide 161 of the desired size.

The second exemplary embodiment having the above described configuration provides the following operation and effect.

Regulatory needle 41 being elastically deformed by movement of workpiece cloth 100 is limited in movement through contact with the inner wall of cylindrical section 162 of needle guide 161. Thus, the movement of workpiece cloth in excess of the predetermined stitch pitch can be prohibited by a simple configuration.

The present disclosure is not limited to the above described exemplary embodiments but may be modified or expanded as follows.

In the first and the second exemplary embodiment, electromagnetic actuator 43 for driving regulatory needle 41 has been provided at head 14 to lower regulatory needle 41 to pierce workpiece cloth 100. In contrast, electromagnetic actuator 43 may be provided within bed 11 and regulatory needle 41 may be configured to protrude upward through the hole such as hole 633 of regulatory plate 61 to pierce workpiece cloth 100 from the underside. In such case, though not shown in detail, a protective element formed in a cap form, for example, may be provided so as to oppose the protruding regulatory needle 41 for user safety and for preventing workpiece cloth 100 from being lifted by the piercing of regulatory needle 41. The protective element, however, needs to be provided so as to allow the underlying workpiece cloth 100 to move freely.

The count of holes provided on regulatory plate 61 of the first and the second exemplary embodiments is not limited to six, but may be modified as required.

Further, support shaft 62 that supports regulatory plate 61 may be eliminated and the disc shaped regulatory plate 61 may be simply fitted into the circular recess 251. In such case, regulatory plate 61 can be removed by use of tools such as tweezers.

While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine, comprising:

a needle bar having a lower end, the lower end being configured to hold a sewing needle;

a needle bar drive mechanism configured to vertically drive the needle bar;

a presser foot that is capable of applying releasable pressure on a workpiece cloth and that is configured to release the pressure to allow manual movement and sewing of the workpiece cloth;

a regulatory needle that includes a tip and that is capable of assuming a pierced state in which the tip is pierced through the workpiece cloth and a non-pierced state, wherein the regulatory needle is movable along with the workpiece cloth while retaining the pierced state of the tip in which the tip is pierced through the workpiece cloth;

a regulatory needle drive unit configured to vertically drive the regulatory needle between the pierced state in which the tip is pierced through the workpiece cloth and the non-pierced state; and a regulatory needle regulator configured to limit horizontal movement of the regulatory needle in the pierced state in which the tip is pierced through the workpiece cloth so that the horizontal movement does not exceed a predetermined stitch pitch.

2. The sewing machine according to claim 1, further comprising a bed and a needle plate configured to support the workpiece cloth from below, wherein the regulatory needle is made of an elastically deformable material, and the regulatory needle regulator is provided at the needle plate or the bed and is provided with a hole that allows penetration of the regulatory needle, and wherein the tip of the regulatory needle being elastically deformed contacts an inner wall of the hole to limit the horizontal movement of the regulatory needle.

3. The sewing machine according to claim 2, wherein the hole is provided in plurality, each hole having a unique inner diameter, and wherein the sewing machine further comprises a hole selector configured to select one of the holes for penetration of the regulatory needle.

4. The sewing machine according to claim 3, wherein the hole selector includes a regulatory plate being formed as a disc that is rotatably supported by the needle plate or the bed, the plurality of holes being formed on circumference of the regulatory plate centering on a center of rotation of the regulatory plate, and wherein the hole for insertion of the regulatory needle is selected by rotating the regulatory plate.

5. The sewing machine according to claim 2, wherein the regulatory needle and the hole are located in a proximity of a needle drop position of the sewing needle.

6. The sewing machine according to claim 1, wherein the regulatory needle is made of an elastically deformable material and has a base end section at an opposite side of the tip, and wherein the regulatory needle regulator includes a needle guide provided with a cylindrical section that covers entire outer periphery of the base end section, and wherein the movement of the regulatory needle is limited by the regulatory needle being elastically deformed contacting an inner wall of the cylindrical section.

7. The sewing machine according to claim 1, wherein the regulatory needle drive unit configured to pierce the regulatory needle through the workpiece cloth before the sewing needle pierced through the workpiece cloth is moved above the workpiece cloth and to retain the pierced state of the regulatory needle until the sewing needle moved above the workpiece cloth is pierced through the workpiece cloth again.

8. The sewing machine according to claim 1, wherein the regulatory needle drive unit includes an actuator configured to vertically drive the regulatory needle.

* * * * *